US005678717A

United States Patent [19]

Hsu

[11] Patent Number: 5,678,717

[45] Date of Patent: Oct. 21, 1997

[54] LAUNDRY BASKET

[75] Inventor: Peyson Hsu, Changhua Hsien, Taiwan

[73] Assignee: Ching Feng Blinds Ind., Co., Ltd., Changhua Hsien, Taiwan

[21] Appl. No.: 712,407

[22] Filed: Sep. 11, 1996

[51] Int. Cl.[6] ..... B65D 7/00

[52] U.S. Cl. ..... 220/4.28; 220/4.31

[58] Field of Search ..... 220/9.2, 9.3, 6, 220/7, 401, 908, 409, 4.28, 4.09

[56] References Cited

U.S. PATENT DOCUMENTS

| | | | |
|---|---|---|---|
| 2,549,013 | 4/1951 | Robles et al. | 220/4.31 |
| 5,236,099 | 8/1993 | Fligs et al. | 220/4.31 |
| 5,373,956 | 12/1994 | Käufer et al. | 220/4.28 |
| 5,474,196 | 12/1995 | Fausel et al. | 220/4.28 |
| 5,560,508 | 10/1996 | Hsu | 220/4.28 X |

*Primary Examiner*—Steven M. Pollard
*Attorney, Agent, or Firm*—Browdy and Neimark

[57] ABSTRACT

A laundry basket for collecting the laundry to be washed, including a base, an upper frame, an upper cover, two substantially C-shaped supporting boards and a shade body. Each corner of the top face of the base is disposed with an arch projection diametrically directed to the center of the base. A top face of the base is disposed with an array of ventilation holes. The edges of the bottom face are disposed with downward extending waved flanges to form multiple legs. The edges of the bottom face of the upper frame are formed with a higher inner wall and two lower middle and outer walls with equal height. Each corner and each side of the inner wall respectively have several corner ribs and restriction ribs outward extending to the space between the middle and outer walls. The corner ribs and restriction ribs have a height equal to that of the inner wall, whereby the left and right sides of the upper frame are respectively formed with two substantially C-shaped receiving channels similar to the C-shaped supporting boards. The shade body is stretched and firmly retained by the supporting boards so as to achieve a better stability and resistance against heavy load. The supporting boards are more firmly associated with the upper frame and the base so as to avoid disassembly of the laundry basket during carriage.

2 Claims, 6 Drawing Sheets

FIG. 6A
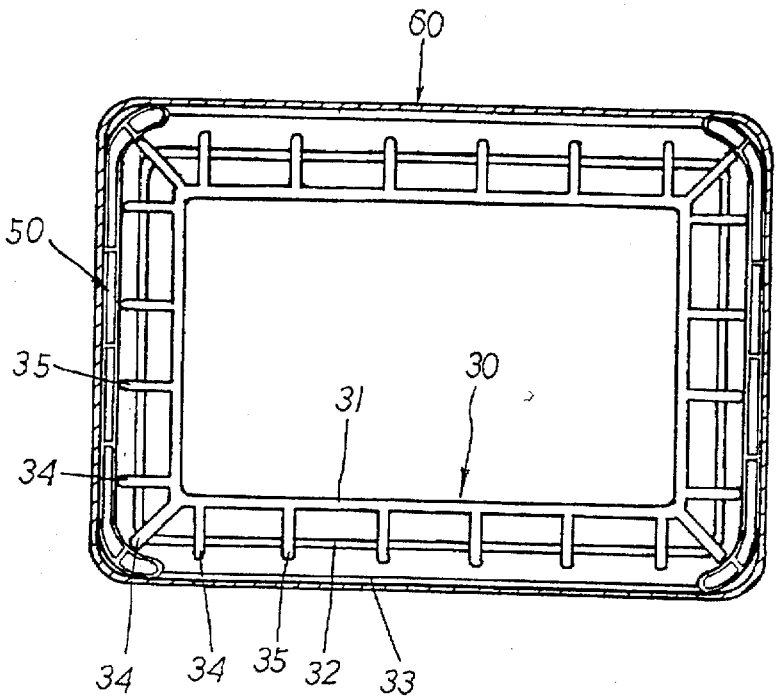
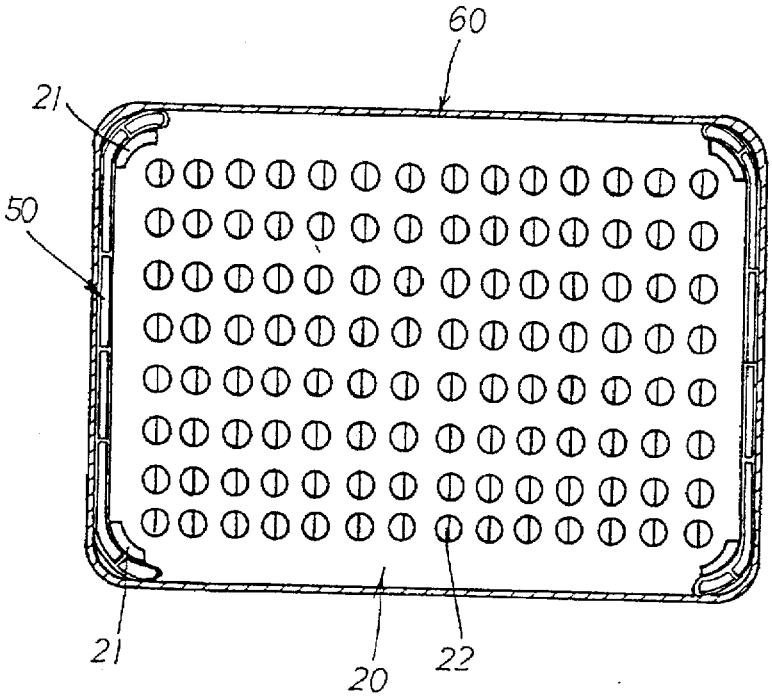
FIG. 6B

LAUNDRY BASKET

BACKGROUND OF THE INVENTION

1. Technical Field of the Invention

The present invention relates to a laundry basket for collecting the laundry to be washed, including a base, an upper frame, an upper cover, two substantially C-shaped supporting boards and a shade body. The laundry basket can be easily disassembled and assembled. The shade body is stretched and firmly retained by the supporting boards so as to achieve a better stability and resistance against heavy load. The supporting boards are more firmly associated with the upper frame and the base so as to avoid disassembly of the laundry basket during carriage. The ventilation holes and the cooperative waved flanges of the base enable the laundry basket to be stably placed on the ground and permit the gas in the laundry basket to be communicated with the ambient air.

1. Prior Art

FIG. 1 shows a conventional laundry basket including a base 1, an upper frame 2, a cover body 3, four supporting columns 4 and a shade body 5. Each corner of the top face of the base 1 is disposed with an arch projecting wall 6 and an oblique projecting block 7 to define a receiving socket. In addition, the top face of the base 1 is formed with several slots 8. Each corner of the bottom face of the base 1 has a downward extending leg 9. The bottom face of the upper frame 2 is formed with a peripheral groove 10. A lower abutting rib 11 is disposed in the peripheral groove 10. The supporting column 4 is a semi-cylindrical column. The cover body 3 is pivotally connected to the rear edge of the upper frame 2 by hinges.

Referring to FIG. 2, when assembled, the upper open end of the shade body 5 is secured to the outer periphery of the outer frame 2, while the lower open end of the shade body 5 is secured to the outer periphery of the base 1. Then the lower ends of the four supporting columns 4 are respectively inserted into the receiving sockets of the base. The upper ends of the supporting columns 4 are respectively inserted into four arch corners of the peripheral groove 10 of the upper frame 2 to abut against the abutting ribs 11 so as to stretch open the shade body 5.

The above conventional laundry has the following shortcomings:

1. When collapsed or used, the shade body 5 must be strongly stretched up or down for performing the disassembling or assembling operation of the four supporting columns 4 which are inserted into the receiving socket of the base 1 and the peripheral groove 10 of the upper frame 2. Therefore, it is difficult to disassemble or assemble the laundry basket.

2. As shown in FIG. 2, after assembly, a clearance A exists between the shade body 5 and the four supporting columns 4 so that the shade body 5 cannot tightly contact with the four supporting columns 4 to reinforce the same. Therefore, the supporting strength of the four supporting columns 4 is weaker and the laundry basket has poor stability and resistance against heavy load and is subject to swinging.

3. The upper and lower ends of the supporting columns 4 are only inserted into the base 1 and the upper frame 2 without any reinforcement from the shade body 5 so that once the laundry is increased and the weight is heavier, the base 1 or upper frame 2 is apt to detach from the supporting columns 4 during transferring.

SUMMARY OF THE INVENTION

It is therefore a primary object of the present invention to provide a laundry basket in which the lower ends of two substantially C-shaped supporting boards are respectively inclinedly inserted between the arch protections of the base and the shade body and the upper ends of the supporting boards are forced and outward pushed by hands to be fixedly engaged in the receiving channels of the upper frame. Therefore, the assembly and disassembly of the laundry basket can be easily performed.

It is a further object of the present invention to provide the laundry basket in which after assembled, the shade body can entirely touch the supporting boards so as to reinforce the same and enhance the stability of the laundry basket and the resistance against heavy load.

It is still a further object of the present invention to provide the above laundry basket in which the shade body can reinforce the supporting boards so as to prevent the supporting boards from detaching from the upper frame and the base during transferring.

It is still a further object of the present invention to provide the above laundry basket in which a top face of the base is disposed with an array of ventilation holes and the edges of the bottom face are disposed with downward extending waved flanges to form multiple legs, enabling the basket to be stably placed on the ground and permitting the air in the basket to communicate with ambient air.

The present invention can be best understood through the following description and accompanying drawing, wherein:

BRIEF DESCRIPTION OF THE DRAWINGS

FIGS. 6A and 6B show the top face of the base and the bottom face of the upper frame of the laundry basket of the present invention.

DETAILED DESCRIPTION OF THE PREFERRED EMBODIMENT

Figure 1:
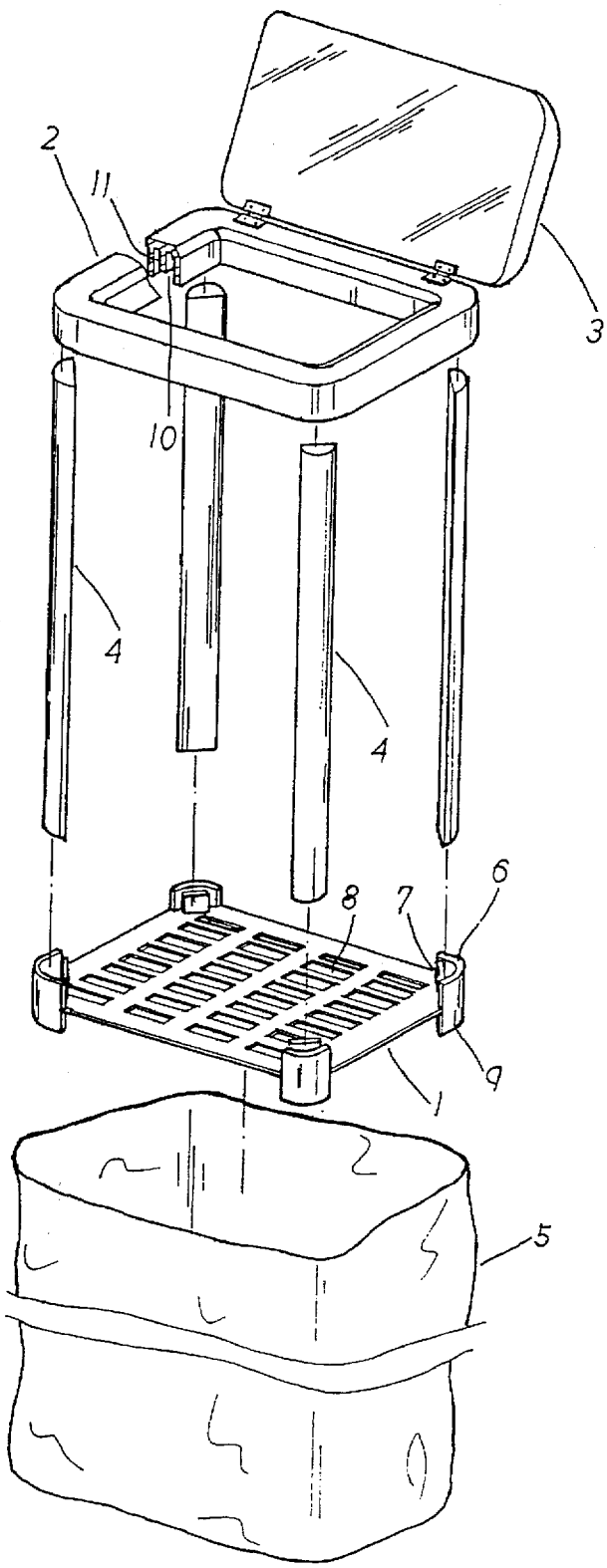
FIG. 1 (PRIOR ART)
FIG. 1 is a perspective exploded view of a conventional laundry basket.
Figure 2:
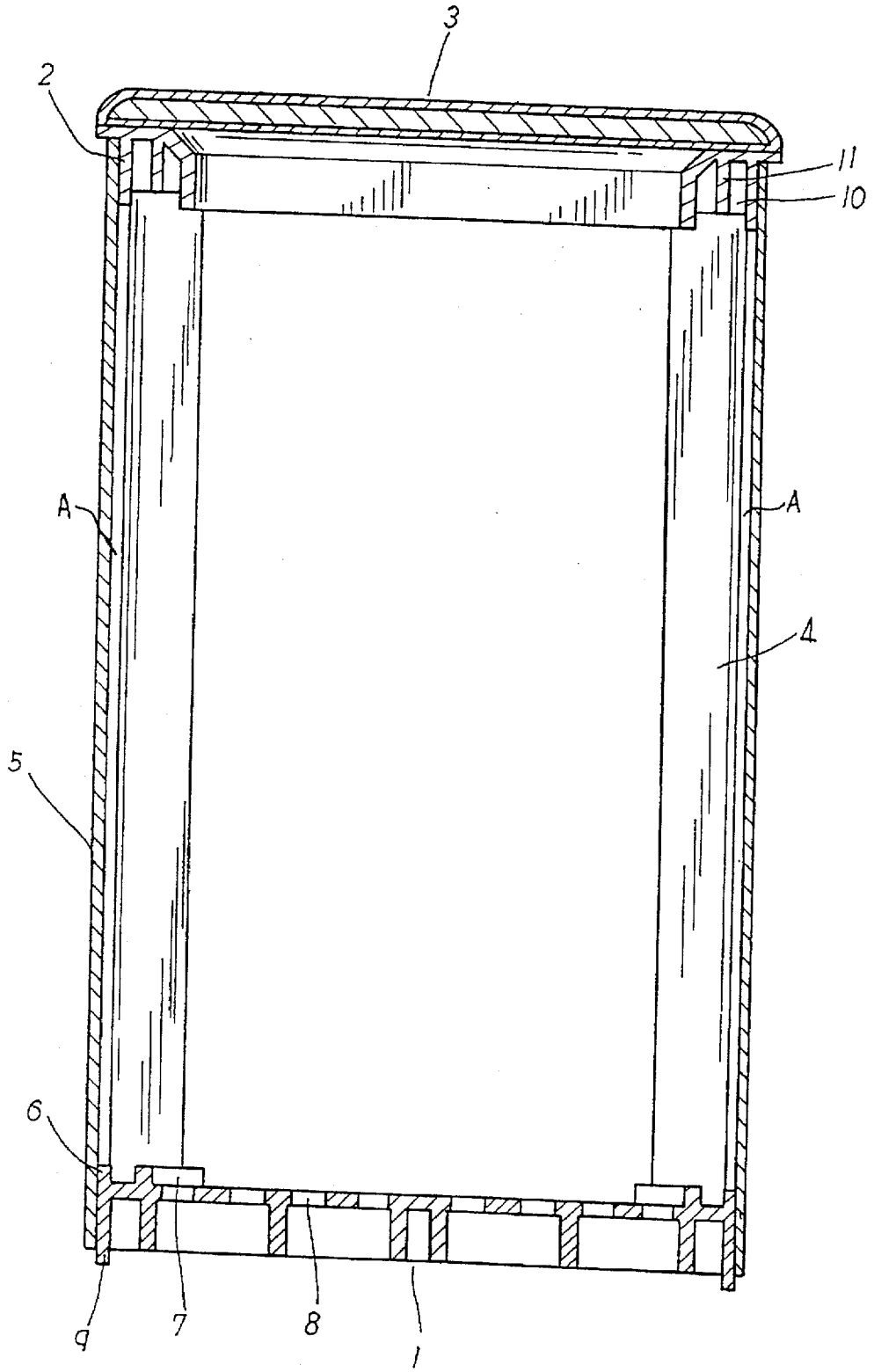
FIG. 2 (PRIOR ART)
FIG. 2 is a sectional assembled view of the conventional laundry basket.
Figure 3:
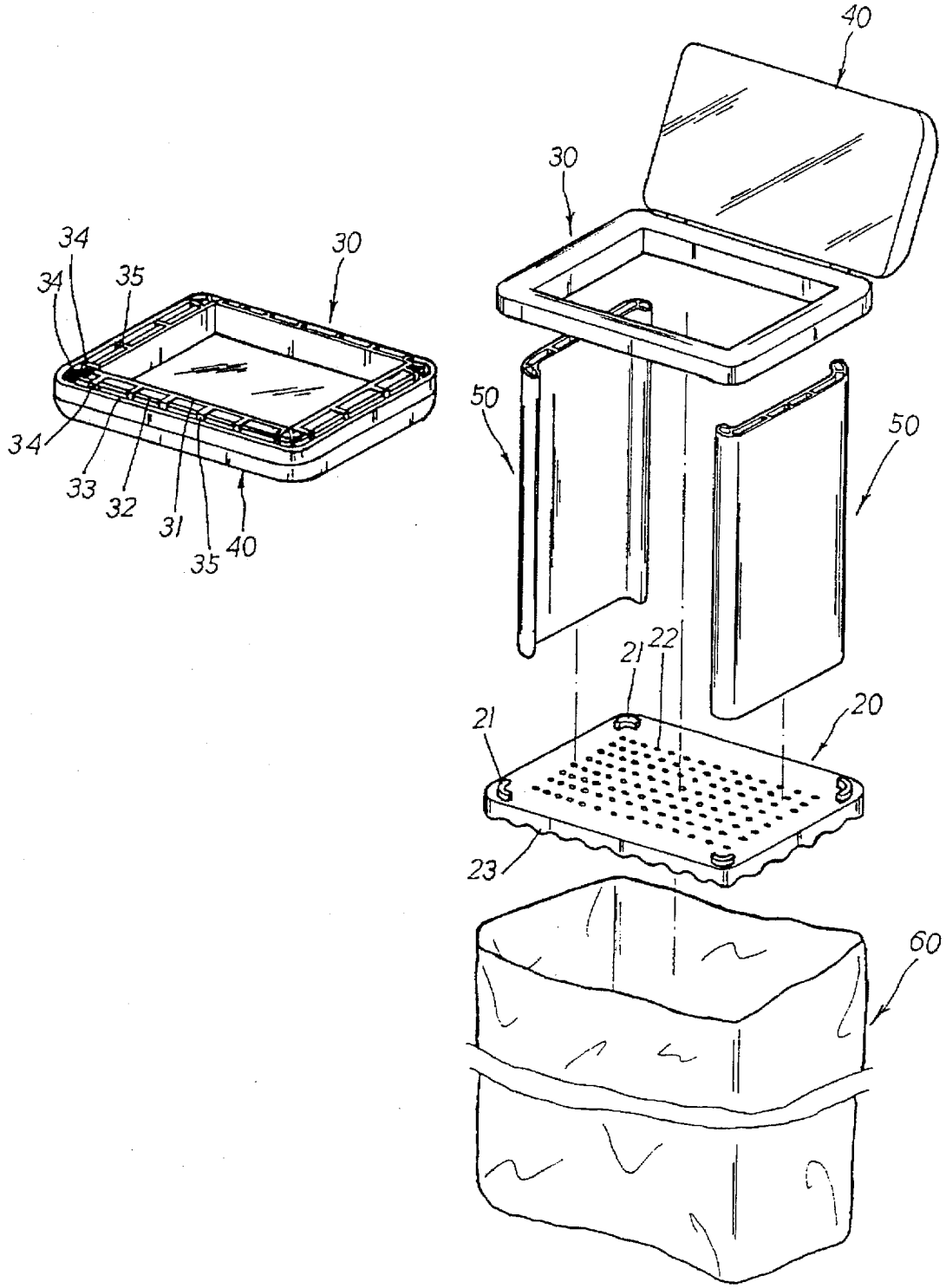
FIG. 3 is a perspective exploded view of the laundry basket of the present invention.

Please refer to FIG. 3. The laundry basket of the present invention includes a base 20, an upper frame 30, an upper cover 40, two substantially C-shaped supporting boards 50 and a shade body 60. Each corner of the top face of the base 20 is disposed with an arch projection 21 diametrically directed to the center of the base 20. The top face of the base 20 is disposed with an array of ventilation holes 22. The edges of the bottom face are disposed with downward extending waved flanges 23 to form multiple legs, enabling the basket to be stably placed on the ground. The edges of the bottom face of the upper frame 30 are formed with a higher inner wall 31 and two lower middle and outer walls 32, 33 with equal height. Each corner of the inner wall 31 has several corner ribs 34 outward extending to the space between the middle and outer walls 32, 33. The corner rib 34 has a height equal to that of the inner wall 31. Each side of the inner wall 31 has several restriction ribs 35 outward extending to the space between the middle and outer walls 32, 33. The restriction rib 35 has a height equal to that of the inner wall 31. Accordingly, the left and right sides of the upper frame 30 are respectively formed with two substantially C-shaped receiving channels similar to the C-shaped supporting boards 50. The upper cover 40 is pivotally connected to the rear edge of the upper frame 30 by hinges.

Figure 4:
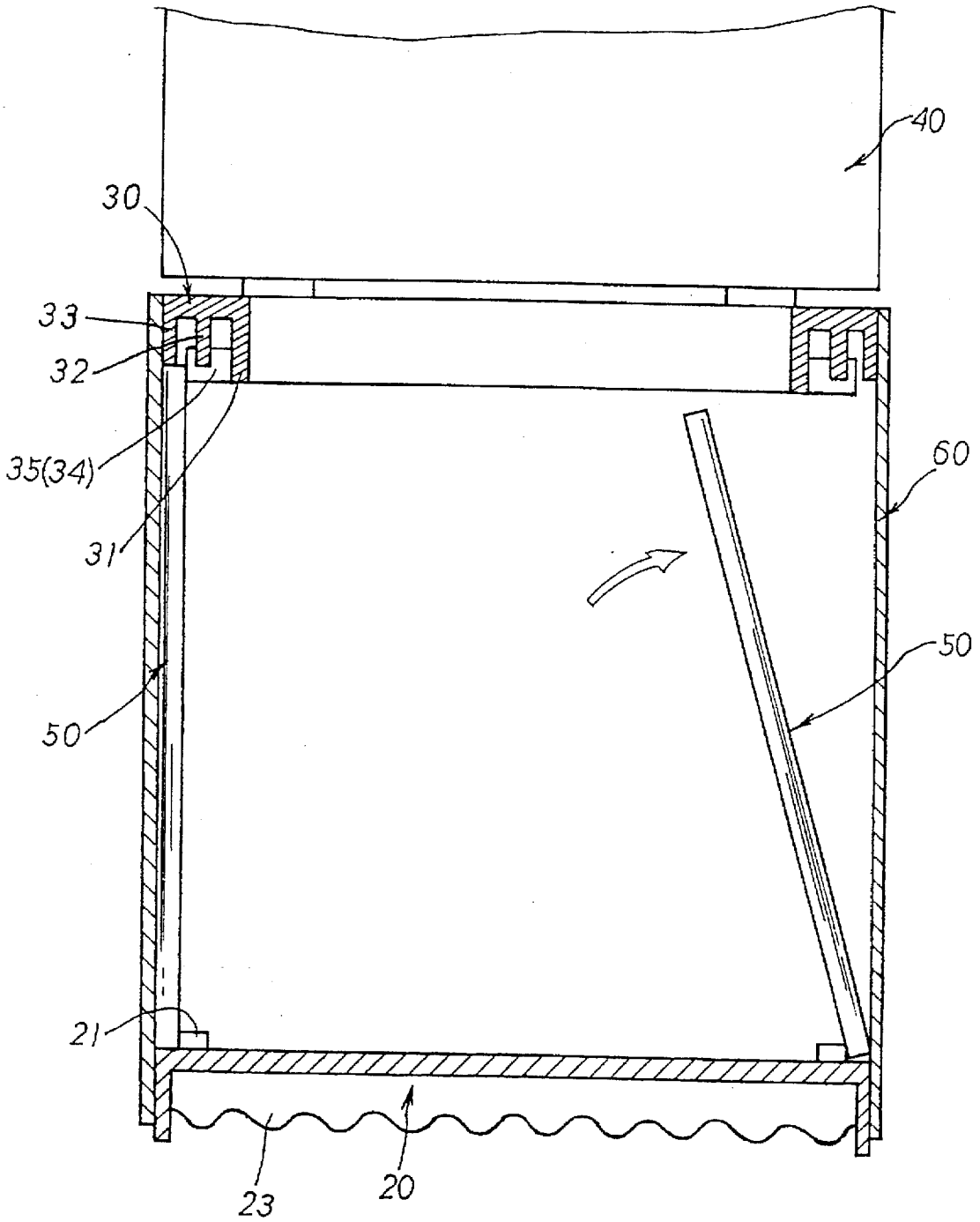
FIG. 4 shows the assembling operation of the present invention.
Figure 5:
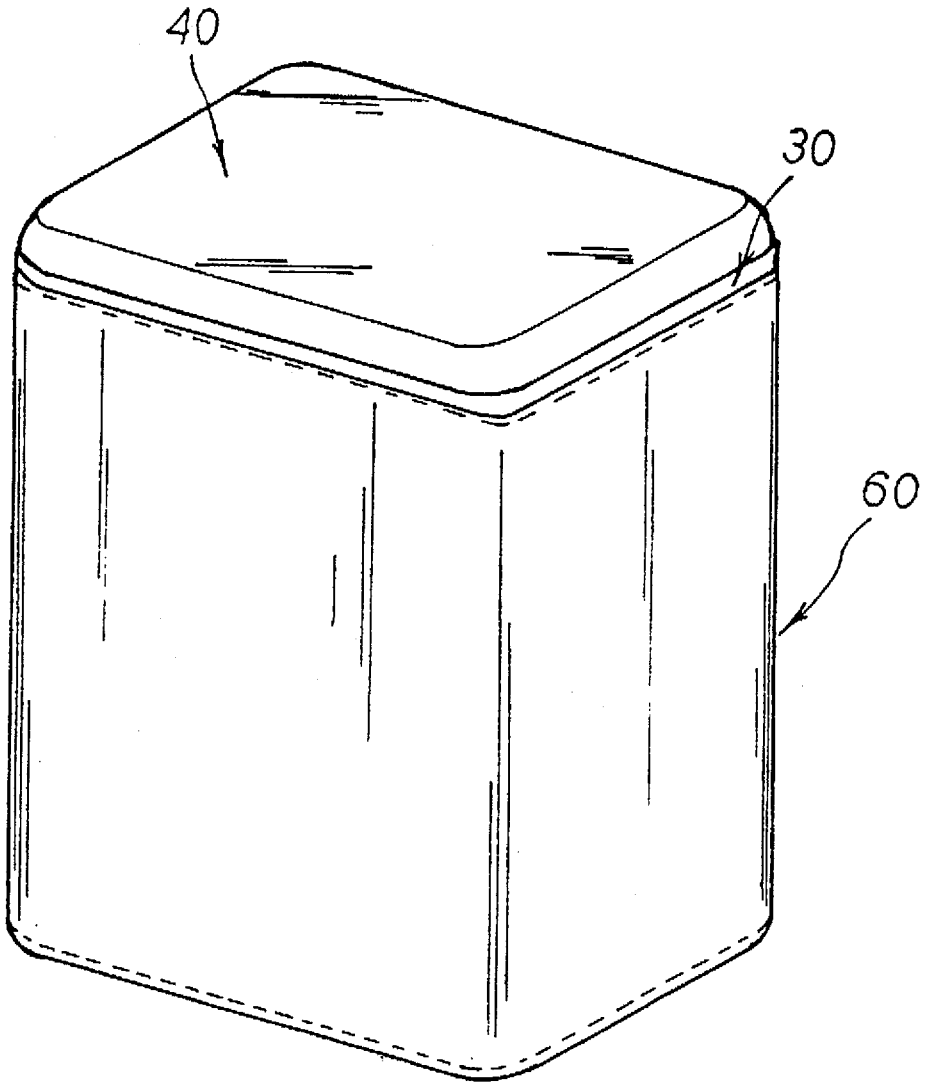
FIG. 5 is a perspective assembled view of the present invention.

Please refer to FIG. 4. When assembled, the upper and lower open ends of the shade body 60 are secured to the outer peripheries of the upper frame 30 and the base 20. Then the supporting boards 50 are placed into the shade body 60. The lower ends of the supporting boards 50 are respectively inclinedly inserted between the arch projections 21 of the base 20 and the shade body 60. At this time, the upper ends of the supporting boards 50 are inward inclined. Then the upper ends of the supporting boards 50 are outward pushed with hands and forced to pass through the inner wall 31, restriction ribs 35 and corner ribs 34 to be fixedly engaged in the receiving channels of the upper frame 30. Also, the inner sides of the lower ends of the supporting boards 50 abut against the outer sides of the arch projections 21 of the base 20. The outer sides of the lower ends of the supporting boards 50 abut against the inner side of the shade body 60. No clearance exists between the supporting boards 20 and the shade body 60, whereby the upper frame 30 is upward supported to stretch open and tension the shade body 60 to form an assembly as shown in FIGS. 5 and 6A–6B.

When dismantling the laundry basket, lifting the upper frame 30 releases, the upper ends of the supporting boards 50 from engagement with the inner wall 31, restriction ribs 35 and the corner ribs 34 of the upper frame 30 so as to disengage the supporting boards from the receiving channels and cause them to incline inward. Then the lower ends of the supporting boards 50 are drawn from the spaces between the arch projections 21 and the shade body 60. At this time, the upper frame 30 can be overlapped on the base 20 for storage.

According to the above arrangement, the present invention has the following advantages:

1. The laundry basket can be easily disassembled and assembled.

2. The shade body 60 is stretched and firmly retained by the supporting boards 50 so as to achieve better stability and resistance against heavy load.

3. The supporting boards 50 are more firmly associated with the upper frame 30 and the base 20 so as to avoid disassembly of the laundry basket during carriage.

4. The ventilation holes 22 and the cooperative waved flanges 23 of the base 20 enable the laundry basket to be stably placed on the ground and permit the gas in the laundry basket to be communicated with the ambient air.

It is to be understood that the above description and drawings are only used for illustrating one embodiment of the present invention, not intended to limit the scope thereof. Any variation and derivation from the above description and drawings should be included in the scope of the present invention.

What is claimed is:

1. A laundry basket comprising a base, an upper frame, an upper cover, two substantially C-shaped supporting boards and a shade body, the upper cover being pivotally connected to a rear edge of the upper free by hinges, an upper open end of the shade body being adapted to be secured to an outer periphery of the upper frame, a lower open end of the shade body being adapted to be secured to an outer periphery of the base, corners of a top face of the base are each disposed with an arch projection diameterically directed to the center of the base;

edges of a bottom face of the upper frame are formed with a higher inner wall and a lower middle wall and an outer wall of equal height, each corner of the inner wall having several corner ribs extending outward to a space between the middle wall and the outer wall, the corner rib having a height equal to that of the of the inner wall, each side of the inner wall having several restriction ribs extending outward to a space between the middle wall and the outer wall, the restriction rib having a height equal to that of the inner wall, wherein a left side and a right side of the upper frame are respectively formed with two substantially C-shaped receiving channels corresponding to a cross-section of the C-shaped supporting boards; and wherein, when being assembled, the supporting boards are placed into the shade body, with lower ends of the supporting boards being respectively inclinedly inserted between the arch projections of the base and the shade body with upper ends of the supporting boards inward inclined, thereafter, the upper ends of the supporting boards are pushed outwardly and forced past the inner wall, restriction ribs and corner ribs and respectively fixedly engaged in the C-shaped receiving channels of the upper frame, wherein, inner sides of the lower ends of the supporting boards abut against outer sides of the arch projections of the base, the outer sides of the lower ends of the supporting boards abut against inner sides of the shade body without any clearance, whereby the upper frame is upward supported to stretch open and tension the shade body to form an assembly.

2. A laundry basket as claimed in claim 1, wherein a top face of the base is disposed with an array of ventilation holes and the edges of the bottom face are disposed with downward extending waved flanges to form multiple legs, enabling the basket to be stably placed on the ground.

* * * * *